United States Patent [19]

Gibson et al.

[11] Patent Number: 4,946,000

[45] Date of Patent: Aug. 7, 1990

[54] UNDISTURBED SOIL SAMPLER

[75] Inventors: Thomas L. Gibson, Utica; Abdul S. Abdul, Troy, both of Mich.

[73] Assignee: General Motors Corporation, Detroit, Mich.

[21] Appl. No.: 361,163

[22] Filed: Jun. 5, 1989

[51] Int. Cl.[5] ..... E21B 25/00

[52] U.S. Cl. ..... 175/251; 175/253; 175/403

[58] Field of Search ..... 175/226, 246, 249, 251, 175/253, 254, 255, 403, 404, 405; 73/864.63; 83/919

[56] References Cited

U.S. PATENT DOCUMENTS 4,605,075 8/1986 Radford et al. ..... 175/246
4,667,754 5/1987 Diedrich ..... 175/249

OTHER PUBLICATIONS

ASTM D 1586-84, "Standard Method for Penetration Test and Split-Barrel Sampling of Soils", *Annual Book of ASTM Standards*, vol. 04.08, pp. 221-225.

ASTM D 1587-83, "Standard Practice for Thin-Walled Tube Sampling of Soils", *Annual Book of ASTM Standards*, vol. 04.08, pp. 226-228.

Zapico et al., "A Wireline Piston Core Barrel for Sampling Cohesionless Sand and Gravel Below the Water Table", *Ground Water Monitoring Review*, vol. 7, Summer 1987, pp. 74-72.

*Primary Examiner*—George A. Suchfield
*Assistant Examiner*—Terry Lee Melius
*Attorney, Agent, or Firm*—George A. Grove

[57] ABSTRACT

A soil sampler assembly for obtaining undistrubed soil samples having an outer corer member for coring the soil during sampling and including first and second ends and also having an inner sampling member having first and second ends with the inner sampling member being removably disposed within the outer corer member for receiving a soil sample and adapted to be removed from the outer corer means without disturbing the soil sample.

4 Claims, 1 Drawing Sheet

UNDISTURBED SOIL SAMPLER

TECHNICAL FIELD

The invention relates to soil samplers used for obtaining undisturbed representative soil samples from the unsaturated zone above an aquifer.

DESCRIPTION OF THE PRIOR ART

Soil sampling is employed to test and classify the constituents in the soil to determine, for example, the structural bearing ability of the soil, the depth of the water table and to determine the various elements which may be found in each constituent which makes up the soil. Further, the sampling devices of the prior art have recently been employed to determine the depth to which pollutants, such as oily fluids including organic and inorganic compounds, freon extractables, PCBs and heavy metals such as chromium, nickel, lead, zinc, cadmium and iron, have penetrated the soil.

The various sampling assemblies are employed in the prior art to obtain soil samples from the unsaturated zone above the water table. Some of the assemblies include the split spoon sampler, the Shelby tube and the Waterloo vacuum sampler and are commonly known in the art. More specifically, the split spoon sampler includes an integral hollow tube which is particularly adapted to be driven into a soil surface using a truck-mounted drilling rig or the like. Each time the split spoon sampler is driven into the soil, the assembly is then removed and the core, or soil sample, is removed from the device. However, the cores taken from the standard split spoon sampler typically suffer disturbance and contamination because the split spoon sampler is intended to be opened in the field, the samples removed, and the device reused over and over. Additionally, in order to take coring samples through an entire aquifer, the split spoon sampler is driven into the same bore hole several times, taking short cores each time. This procedure can spread cross-contamination from the surface layers downward to the underlying regions.

Further, the split spoon sampler was originally designed for use in geotechnical engineering where information about the resistance to driving the sampler into the subsurface layers is more important than sample recovery and soil stratification. Accordingly, the split spoon sampler has a limitation that the drier, more friable soil in the unsaturated zone is compacted around the sampler when it is driven into the ground, and whatever part of the soil enters the opening often falls out again when the sampler is pulled from the ground. This adds to the cross-contamination from surface layers downward to the underlying regions. Although a retainer is sometimes used with the split spoon sampler, the type of retainer used must be forced open by the soil before it can enter the sampler. This force adds to resistance and tends to repel soil and prevent it from entering the sampler. In the absence of a mechanism to open and close a retainer, the resistance intended to hold the soil in the sampler prevents it from entering the spoon as well.

Similarly, the Shelby tube comprises an open-ended aluminum tube with no retaining means and is generally restricted to taking moist clay samples. Accordingly, the Shelby tube is not very useful for sampling partially saturated sandy material. Finally, the Waterloo vacuum sampler is a lesser known sampling device developed at the University of Waterloo, Ontario, Canada which employs a vacuum applied to the top of a Shelby-type tube to hold material in the tube as it is withdrawn from the ground. However, this suction on the soil core can only be effective on material from below the water table that is saturated with liquid, and the high vacuum required to balance the weight of the core material causes upward migration of pore fluids and volatilizes low-boiling constituents in the sample.

Each of the above-mentioned devices are deficient in that an undisturbed soil sample cannot be taken with the prior art assemblies and later analyzed without a high probability of cross-contamination of the surface layers. This cross-contamination makes it difficult to accurately determine the depth to which various constituents or pollutants have penetrated the soil. The subject invention overcomes all of the deficiencies in the prior art in a very efficient and cost effective soil sampler which is capable of taking and maintaining undisturbed core samples.

SUMMARY OF THE INVENTION AND ADVANTAGES

The subject invention is directed toward a soil sampler assembly for obtaining undisturbed soil samples having an outer corer means for coring the soil during the sampling and including first and second ends. The assembly also includes an inner sampling means having first and second ends and which is removably disposed within the outer corer means for receiving a soil sample and adapted to be removed from the outer corer means without disturbing the soil sample. Accordingly, the undisturbed soil sampler of the subject invention produces a core sample which is disposed in the inner sampling means and which may be removed from the outer corer means without disturbing the various layers of the core sample, thereby avoiding any cross-contamination and further allows the sample to be removed from the bore site and taken back to a laboratory so that a more detailed profile of the soil strata and contaminant distribution may be made.

BRIEF DESCRIPTION OF THE DRAWINGS

Other advantages of the present invention will be readily appreciated as the same becomes better understood by reference to the following detailed description when c in connection with the accompanying drawings wherein.

DESCRIPTION OF THE PREFERRED EMBODIMENT

Figure 1:
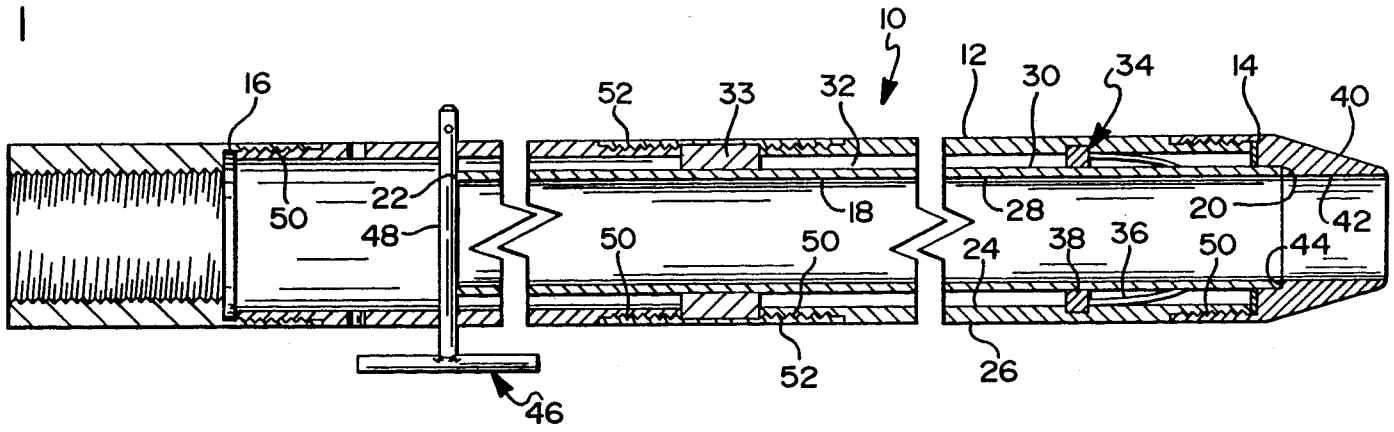
FIG. 1 is a cross-sectional side view taken along the longitudinal axis of the undisturbed soil sampler.

A soil sampler assembly for obtaining undisturbed soil samples of the type adapted to be driven into a soil surface by means of a truck-mounted drill rig or the like is generally shown at 10 in FIG. 1. The soil sampler assembly 10 includes an outer corer means 12 for coring the soil as the assembly 10 is driven into the soil during sampling and includes first and second ends 14, 16, respectively. The assembly 10 also includes an inner sampling means 18 having first and second ends 20, 22, respectively, which is removably disposed within the outer corer means 12 for receiving a soil sample or core when the assembly 10 is driven into a soil surface. The inner sampling means 18 is particularly adapted to be removed from the outer corer means 12 without disturbing the soil sample and without causing cross-contamination of soil core segments. More specifically, the outer corer means includes an elongated hollow tubular corer member 12 which defines inner and outer surfaces 24, 26, respectively. The inner sampling means includes an elongated hollow tubular sampling member 18 which also defines inner and outer surfaces 28, 30, respectively, and which is disposed concentrically within the outer corer member 12. Said another way, the outer corer member 12 and the inner sampling member 18 define a pair of tubes which are disposed concentrically with respect to each other and which present a gap or space 32 between the outer surface 30 of the inner sampling member 18 and the inner surface 24 of the outer corer member 12. A cylindrical stabilizer ring 33 is disposed about the circumference of the outer surface 30 of the inner sampling member 18 and between this outer surface 30 and the inner surface 24 of the outer corer member 12 to stabilize and support the inner sampling member 18 in its concentric disposition within the outer corer means 12 when the assembly 10 is driven into the ground.

The soil sampler assembly 10 further includes a retaining means, generally indicated at 34, which is disposed adjacent the first end 14 of the outer corer member 12 for retaining soil in the inner sampling member 18 when the inner sampling member 18 is removed from the outer corer means 12 for further study either in the field or at a laboratory. The retaining means 34 is disposed between the inner surface 24 of the outer corer member 12 and the outer surface 30 of the inner sampling member 18. Said another way, the retaining means 34 is disposed in a portion of the gap 32 defined by the concentric hollow tubes of the corer member 12 and the inner sampling member 18.

Figure 2:
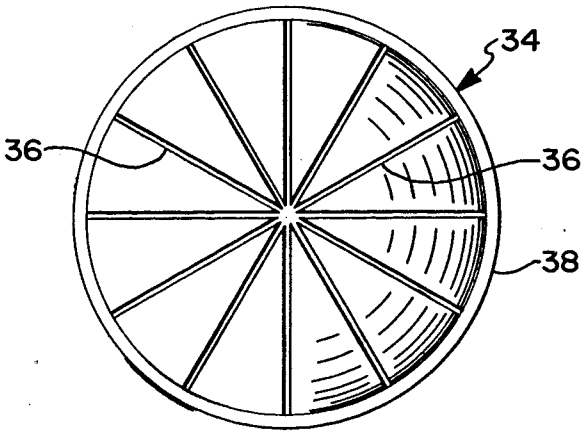
FIG. 2 is a top view of the retaining means.
Figure 3:
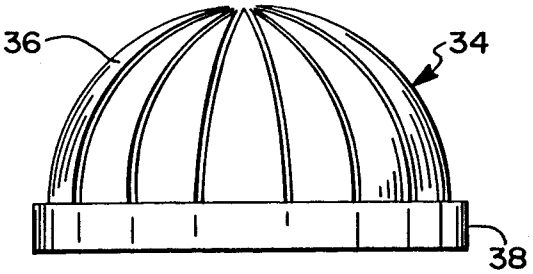
FIG. 3 is a side view of the retaining means.

The retaining means 34 includes a plurality of arcuate leaves 36, as shown in FIGS. 2 and 3, moveable between open and closed positions and which are moveably attached to a mounting ring 38. The mounting ring 38 is disposed about the outer surface 30 of the inner sampling member 18 when the inner sampling member 18 is disposed within the outer corer member 12. Further, when the sampling member 18 is disposed within the outer corer member 12, the leaves 36 of the retaining means 34 are forced outwardly to their open position and are disposed about the circumference of the outer surface 30 of the inner sampling member 18 and in a portion of the gap 32 presented by the concentric tubes of the outer corer member 12 and the inner sampling member 18. When the sampling member 18 is removed from the outer corer member 12 after a soil sample has been taken, the leaves 36 of the retaining means 34 move to the closed position, thereby preventing loose soil from the sample from falling down into the bore hole and causing cross-contamination from those surface layers downward to the underlying regions.

The assembly 10 also includes a conical drive point 40 threadably disposed at the first end 14 of the outer corer member 12. The conical drive point 40 defines a passageway 42 communicating with the hollow tubular sampling member 18 through which soil may pass as the assembly 10 is driven into a soil surface. The drive point 40 presents a circular surface 44 disposed at one end of the passageway 42. When disposed within the outer corer member 12, the first end 20 of the tubular inner sampling member 18 is disposed in abutting engagement with the circular surface 44 thereby forcing the leaves 36 of the retaining means 34 to the open position as alluded to above.

The assembly 10 further includes a locking means, generally indicated at 46, for locking the first end 20 of the inner sampling member 18 in abutting engagement with the circular surface 44 of the drive point 40 when the assembly 10 is driven into a soil surface. The locking means 46 includes a key 48 disposed through an aperture in the corer member 12 and which is disposed in locking engagement with the second end 22 of the inner sampling member 18 to lock the first end 20 of the sampling member 18 in abutting engagement with the circular surface 44 of the drive point 40.

The assembly 10 may be of any length depending upon the depth of the bore desired for any given sample. To this end, the outer corer member 12 is threaded at 50 on its outer surface 26 and at its first and second ends 14, 16. While the conical drive point 40 is threadably disposed at the first end 14 of the lead corer member 12, additional corer members may be coupled at the second end 16 by means of a coupler 52 which threadably interconnects the two assemblies. Further, and whether or not two assemblies are coupled together, a drill rig adapter 52 is threadably disposed at the second end 16 of the corer member 12 and opposite the conical drive point 40 so that the assembly may be mounted to a truck mounted drill rig or the like and then driven into the ground.

After the assembly has been driven into a bore hole, the key 48 of the locking means 46 is removed and the inner sampling member 18 may be removed to preserve the soil samples so that studies of the depth of penetration of the pollutants into the soil may be made. To this end, both the outer corer member 12 and the inner sampling member 18 are split longitudinally into half cylinders and include hinge means, not shown, disposed at one side of the mating surfaces and means for clasping the other sides of the half cylinders together during sampling. When either the inner sampling member 18 or both the inner sampling member and the outer corer member 12 are removed from the ground with the soil corer sample, both the inner sampling member 18 and the outer corer member 12 may be easily opened for inspection of the soil sample. Further, the sample may be removed from the field site and transported back to a laboratory for further study of the sample. In this way, the sample is preserved intact, cross-contamination of the surface layer is eliminated, and a more detailed profile of the soil strata may be made to more accurately determine the particle size distribution in the subsurface medium.

The invention has been described in an illustrative manner, and it is to be understood that the terminology which has been used is intended to be in the nature of words of description rather than of limitation.

Obviously, many modifications and variations of the present invention may be made in light of the above teachings. It is, therefore, to be understood that within the scope of the appended claims, the invention may be practiced otherwise than as specifically described.

The embodiments of the invention in which an exclusive property or privilege is claimed are defined as follows:

1. A soil sampler assembly for obtaining undisturbed soil samples comprising:

an elongated hollow tubular outer corer means for coring the soil during sampling, said means defining inner and outer surfaces and including first and second ends;

an elongated hollow tubular inner sampling means defining inner and outer surfaces having first and second ends and being removably disposed within said outer corer means for receiving a soil sample and adapted to be removed from said outer corer means without disturbing the soil sample, and retaining means disposed adjacent the first end of said corer means between its inner surface and the outer surface of the sampling means for retaining soil in said sampling means, the retaining means including a plurality of flexible arcuate leaves extending toward the first end and movable between an open position and a closed cup-like position, the leaves being held in the open position by the outer surface of the sampling means when it is fully disposed within the corer means and the leaves being adapted to continually self-close to the cup-like position about the end of the sampling member as it is withdrawn from the corer member.

2. An assembly as set forth in claim 1 further characterized by including a conical drive point disposed at said first end of said outer corer member, said conical drive point defining a passage way communicating with said hollow tubular sampling member through which soil may pass as said assembly is driven into a soil surface; said drive point presenting a circular surface disposed at one end of said passage way, said first end of said tubular sampling member disposed in abutting engagement with said circular surface and forcing said leaves of said retaining means to said open position when said sampling member is disposed within said corer member.

3. An assembly as set forth in claim 2 further characterized by including a locking means for locking said first end of said inner sampling member in abutting engagement with said circular surface of said drive point when said assembly is driven into a soil surface.

4. An assembly as set forth in claim 3 further characterized by said locking means including a key disposed through an aperture in said corer member and in locking engagement with said second end of said inner sampling member to lock said first end of said sampling member in abutting engagement with said circular surface of said drive point.

* * * * *